United States Patent [19]

Learmont

[11] 4,054,320

[45] Oct. 18, 1977

[54] METHOD FOR THE REMOVAL OF RADIOACTIVE WASTE DURING IN-SITU LEACHING OF URANIUM

[75] Inventor: Robert P. Learmont, Feeley Township, Itasca County, Minn.

[73] Assignee: United States Steel Corporation, Pittsburgh, Pa.

[21] Appl. No.: 717,066

[22] Filed: Aug. 24, 1976

[51] Int. Cl.[2] ..... E21B 43/28; E21C 41/14

[52] U.S. Cl. ..... 299/4; 61/.5; 166/278; 166/305 D

[58] Field of Search ..... 299/4, 5; 61/.5; 166/276, 278, 305 D, 247

[56] References Cited

U.S. PATENT DOCUMENTS

| | | | |
|---|---|---|---|
| 2,546,586 | 3/1951 | Cross | 166/278 X |
| 2,961,399 | 11/1960 | Alberti | 61/.5 X |
| 3,108,439 | 10/1963 | Reynolds et al. | 61/.5 |
| 3,262,274 | 7/1966 | Nelson | 61/.5 |
| 3,274,784 | 9/1966 | Shock et al. | 166/247 X |
| 3,513,100 | 5/1970 | Stogner | 61/.5 X |
| 3,808,128 | 4/1974 | Heckman | 166/247 X |

*Primary Examiner*—Ernest R. Purser
*Attorney, Agent, or Firm*—Arthur J. Greif

[57] ABSTRACT

In the in-situ leaching of valuable minerals such as uranium, a leaching solution is injected into the mineral-bearing formation, permitted to remain in contact with the formation to effect the solubilization of desirable mineral values therefrom, and then withdrawn either from the original injection well or a nearby production well. Presently, upon removal from the production well, the mineral bearing solution is filtered aboveground prior to chemical extraction of the valuable minerals. A serious problem has arisen in that highly radioactive radium ions have been found to accumulate, both in the circulating leach solution and in various aboveground equipment resulting in serious waste disposal problems. The instant method utilizes a sand pack containing barium salts, which ion exchange with the radium ions so that the latter are prevented from reaching the surface.

8 Claims, 1 Drawing Figure

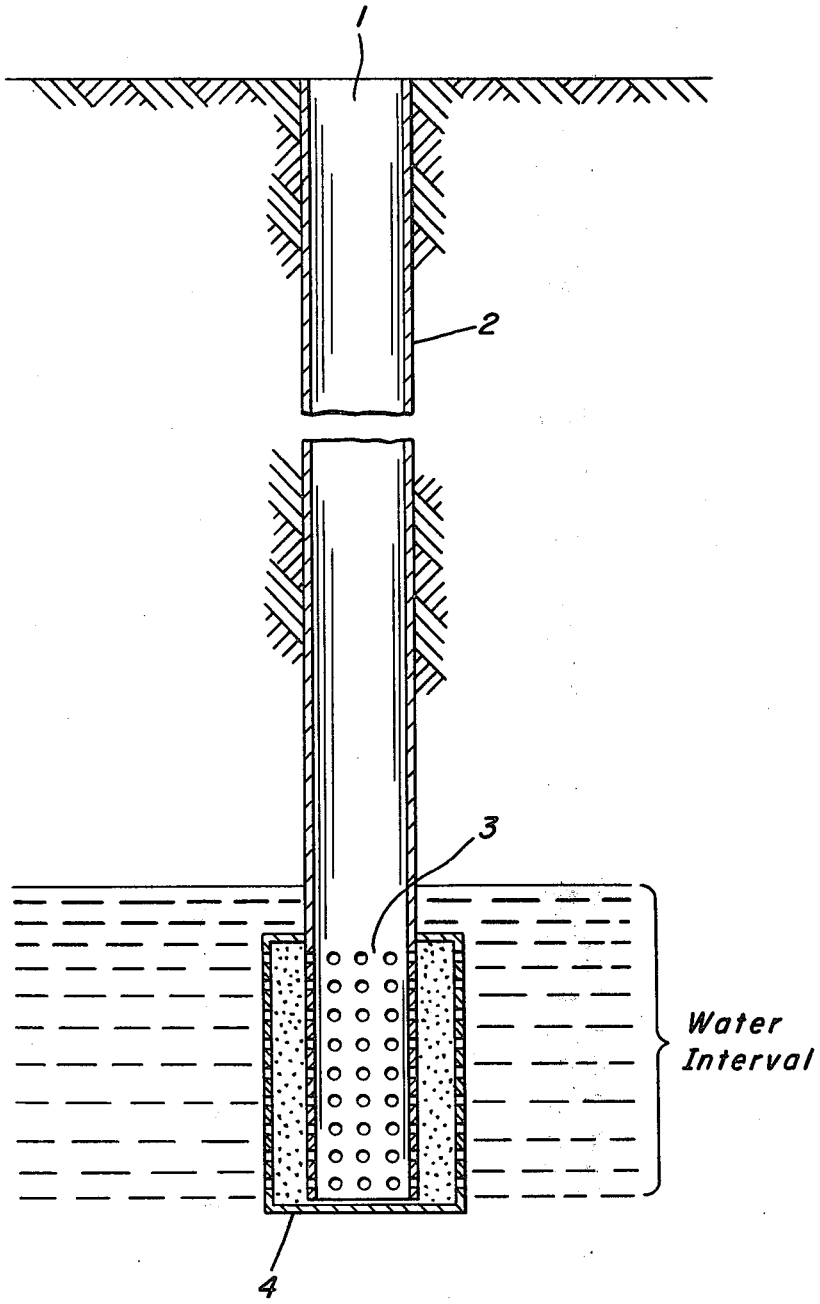
1
2
3
4
Water
Interval

METHOD FOR THE REMOVAL OF RADIOACTIVE WASTE DURING IN-SITU LEACHING OF URANIUM

In-situ leaching of uranium is accomplished by injection of a leach solution into the uranium-bearing formation via injection wells and withdrawal of a uranium-bearing pregnant solution from either the same well or nearby production wells. The composition of the leach solution may be either acidic or alkaline, depending upon the particular uranium mineral to be leached, the other minerals present in the host formation, and the chemical composition of the ground water itself. For example, in siliceous sand or sandstone, sulfuric acid is generally employed; whereas in calcareous environments, sodium or ammonium carbonates are generally considered more suitable. As a result of such leaching, other elements both desirable and undesirable are also dissolved within the leach solution. Among these is $Ra_{226}$, as well as other undesirable radioactive isotopic waste. While the dissolution of such radioactive isotopic waste occurs in both acidic and alkaline leach systems, the dissolution of $Ra_{226}$ is a particularly significant problem in alkaline leach systems.

At the aboveground plant, pregnant solution is processed by filtering, often utilizing granular charcoal filter medium, and thereafter by passage through resin ion-exchange systems in which uranium is extracted. Following uranium extraction, the barren solution is fortified by suitable chemical additions and is reinjected into the formation to accomplish more leaching. Generally, a small fraction of the $Ra_{226}$ or other radioactive waste in solution is coabsorbed with the uranium by the ion-exchange resin. There is therefore a tendency for such radioactive waste to accumulate both in the recirculating leach solution, on the filter medium, and in other contiguously situated aboveground equipment, such as settling tanks, thickeners, storage systems, etc. Accumulation of radioactivity in such equipment tends to build-up to unduly high radiation levels, creating a hazard to personnel working in the area. Additionally, the radioactive level of the leach solution, itself, tends to reach high proportions—necessitating the disposal thereof. Such "hot" material is normally disposed of in very deep disposal wells. Recent findings have, however, indicated that this method of disposal may in itself create serious environmental objections. The threat of migration of low level radioactive waste in such deep wells was previously considered negligible. Recent findings have, however, indicated an apparent migration, much more rapid than scientists thought possible. Thus, some time ago, radioactive land fill was found to cause significant problems in Grand Junction, Colorado, but this sutuation was initially throught to be an isolated case. However, evidence of such migration and purcolation of radioactive wastes have now been uncovered in Port Hope, Ontario, and in Maxey Flats, Kentucky.

It is therefore a principle object of the instant invention to provide a method for abating the contamination of aboveground systems and equipment.

It is a further object of this invention to provide a method of minimizing the problem of waste disposal, created by recovered uranium-bearing solutions made radioactive by radium ions.

The above and other objects of the instant invention will become more apparent from a reading of the following description, when read in conjunction with the appended claims and the drawing in which:

The FIGURE representationally illustrates a means for interposing a barium-containing sand pack over the water interval (of pregnant solution) which is to be pumped from a production well.

The ability of barium containing materials to ion-exchange with isotopic waste materials, especially radium, is well known. See for example, U.S. Pat. No. 2,961,399, which teaches the use of barite-containing ion-exchange materials in a variety of forms for the absorption of radioactive ions from contaminated solutions. However, while such methods have been employed to purify solutions aboveground, they have not eliminated the problems, noted above, associated with (a) contamination of the filter itself, equipment contiguous to such filters and (b) disposal of such radioactive filters and contaminated equipment. These problems are, however, substantially abated or totally eliminated by use of the instant method in which the "screened" portion of a well (both injection and production wells) may be surrounded by a sand pack composed of a graded size fraction of a barium-containing ion-exchange material, whereby substantially all of the pregnant solution flowing through the well screen into the well casing, is caused to first pass through the ion-exchange sand pack.

A specific example of how this invention is utilized in the in-situ leaching of uranium ores is illustrated in the FIGURE, which depicts a typical well 1, constructed of 6 inch diameter pipe 2, the lower portion of which 3 is screened over an interval of 40 feet. A sand pack 44 is interposed between the screened interval of the pipe and the incoming pregnant solution so as to completely surround the screened interval. In the specific case where the flow rate of a production well averaged about 60 gallons per minute, the superficial velocity of the leach solution as it passed radially through the sand pack, was calculated to average about 3 cm per minute. A sand pack, having a radial thickness of only 8 cms, a specific gravity of 3.8 gm/cc, and a void volume of approximately 40%, and comprised of size-graded 62% $BaSO_4$ provided 99+% $Ra_{226}$ reduction. While barium sulfate, because of its inertness and low solubility, is preferred as the main component of such a sand pack, other well known barium containing minerals, e.g. barium carbonate, may be effectively employed. Since the efficiency of removal is dependent on the surface area of the sand particles used in the pack, it is desirable that such particles have a top size of about 10 mesh. On the other hand, such particles will preferably not be too small, i.e. the pack should not contain slimes or fines that would penetrate or blind the well screen, or otherwise reduce the permeability to an unaccepted level. To make the use of such a sand pack practicable, it is desirable that the barium containing, ion-exchange material be employed in an amount at least sufficient to decrease the radium ion concentration of the pregnant solution to a level (i) which is no greater than about 10% of the level of the unexchanged pregnant solution, and (ii) desirably to that of current U.S. regulations, which presently specify a maximum permissible concentration in water of 3 pico curies per liter. Preferably, the sand pack radial dimension, measured outward from the outer surface of the well screen will be greater than about 10 cm so as to better insure that the radium ion concentration will be decreased to a level no greater than 2% of the unexchanged pregnant solution.

It should be understood that while the above description has been specifically directed to the use of such a barium-containing sand pack surrounding only the production well, that the instant invention is not limited thereto. Thus, since the use of such sand packs have been found to be extremely effective for absorbing and thereby immobilizing $Ra_{226}$, they may similarly be utilized to surround injection wells, so as to abate the buildup to serious contamination levels of recirculated leach solutions.

I claim:

1. In the process for the in-situ leaching of mineral values from an underground formation, wherein an aqueous solution of a leaching agent is delivered to the formation through an injection well, the solution remains in contact with the formation for a period of time sufficient to effect the solubilization of said mineral values therefrom, whereby said contact also effects the solubilization of undesirable mineral values including radium-ion containing radioactive waste, and the pregnant solution with said mineral values dissolved therein is thereafter pumped from the formation to a level aboveground through a production well, comprising a tube-like member having apertures at a lower section thereof, said apertured section having a length at least coterminus with the interval of pregnant solution which is to be pumped from said production well, whereby the radioactive waste-containing pregnant solution results in the contamination of aboveground equipment and the creation of waste disposal problems;

an improved process, for abating said contamination and minimizing said problem of waste disposal, which comprises, substantially coterminus with the interval of said pregnant solution to be pumped from said well, interposing a sand pack between the outer surface of said tube-like member and the pregnant solution in the formation, said sand pack containing a graded size fraction of a barium containing ion exchange material in an amount sufficient to decrease the radium-ion concentration of said pregnant solution to a level which is no greater than 0.1 the level of the incoming unexchanged pregnant solution in said formation.

2. The method of claim 1, wherein the particles of said sand pack are properly graded in size so as to not substantially reduce the permeability thereof.

3. The method of claim 2, wherein said ion-exchange material is barium sulfate.

4. The method of claim 3, wherein said material is barium sulfate in an amount sufficient to decrease the radium ion concentration of the recovered pregnant solution to a level below 3.3 pico curies per liter.

5. The method of claim 3, wherein said barium sulfate is employed in an amount sufficient to decrease the radium ion concentration to a level no greater than 0.02 the level of said unexchanged pregnant solution.

6. The method of claim 5, wherein said leaching agent is selected from the group consisting of $NH_4$ & Na carbonates, and said radium ion is $Ra_{226}$.

7. The method of claim 3, wherein said injection well comprises a tube-like member having apertures at a lower section thereof; and further comprising, surrounding at least a substantial portion of the length of the apertured section of said injection well, with a sand pack containing a graded size fraction of a barium-ion exchange material in an amount sufficient to absorb at least a major fraction of the radium-ion concentration in the aqueous leach solution being delivered to the formation.

8. The method of claim 3, wherein said injection well is utilized as said production well.

* * * * *